US005108323A

United States Patent [19]

Veronesi et al.

[11] Patent Number: 5,108,323

[45] Date of Patent: Apr. 28, 1992

[54] DEPLOYMENT SYSTEM FOR SECONDARY PROPULSOR UNIT

[75] Inventors: Luciano Veronesi, O'Hara Township, Allegheny County; George A. Hritz, Jr., Cheswick, both of Pa.

[73] Assignee: Westinghouse Electric Corp., Pittsburgh, Pa.

[21] Appl. No.: 585,426

[22] Filed: Sep. 20, 1990

[51] Int. Cl.[5] ..... B63H 5/12

[52] U.S. Cl. ..... 440/53; 114/338

[58] Field of Search ..... 440/53-56, 440/58-61; 114/337, 338, 336, 340, 332

[56] References Cited

U.S. PATENT DOCUMENTS

| | | | |
|---|---|---|---|
| 2,151,004 | 3/1939 | Barclay | 440/54 |
| 2,335,597 | 11/1943 | Mathewson | 440/58 |
| 2,960,057 | 11/1960 | Taylor | 440/55 |
| 4,294,186 | 10/1981 | Wardell | 440/53 |
| 4,831,297 | 5/1989 | Taylor et al. | 310/87 |

FOREIGN PATENT DOCUMENTS

| | | | |
|---|---|---|---|
| 3718222 | 2/1988 | Fed. Rep. of Germany | 440/54 |
| 8700535 | 10/1988 | Netherlands | 440/59 |

OTHER PUBLICATIONS

Brochure of Jastram-Werke GmbH KG entitled "Jastram Forschung-From the Idea to the Marketable Product" dated Aug. 1988.

*Primary Examiner*—Edwin L. Swinehart

*Attorney, Agent, or Firm*—Joseph C. Spadacene

[57] ABSTRACT

A system is provided for deploying a propulsor unit from the hull of a water vehicle, such as a submarine. The system comprises an opening in a submerged portion of the hull that leads to a chamber for storing the propulsor unit, a cover for covering the hull opening to render the surface of the hull substantially continuous and fluid-dynamic, the cover having first and second sides, each of which conforms to the contour of the hull and the propulsor unit being mounted on the second side of the cover, and a pivotal mounting that hingedly connects the cover and the propulsor unit attached thereto across the opening in the hull for allowing the propulsor unit to move from a first stored position within the storage chamber to a second deployed position in the ambient water surrounding the hull. A drive assembly is provided for pivotally moving the cover and its attached propulsor unit between stored and deployed positions. Finally, a steering assembly is provided that includes a rotatable mounting between the propulsor unit and the cover, and the combination of a spur gear and a a worm for rotatably moving the propulsor unit to a desired angle with respect to the hull of the submarine.

21 Claims, 8 Drawing Sheets

DEPLOYMENT SYSTEM FOR SECONDARY PROPULSOR UNIT

BACKGROUND OF THE INVENTION

This invention generally relates to systems for deploying mechanisms from the hulls of water vehicles, and is specifically concerned with a system for deploying a secondary propulsor unit from the hull of a submarine.

Systems for deploying propulsor units from the hulls of water vessels such as submarines are known in the prior art. However, before the structure and operation of such systems can be fully appreciated, some understanding of the structure and purpose of secondary propulsor systems in such submarines is necessary.

Most submarines include both a primary and a secondary propulsor unit. In nuclear submarines, the primary propulsor unit consists of a screw propeller driven by a shaft which is in turn powered by a nuclear reactor. In the event that the primary propulsor unit should fail, one or more secondary propulsor units are provided. Each secondary propulsor unit generally consists of a submersible electric motor connected to a screw propeller by way of a shaft. During the normal operation of the submarine, the primary propulsor unit drives the submarine, and the secondary propulsor units are withdrawn through an opening in the submarine hull that leads to a storage chamber which protects the propulsor units from mechanical shock and prevents them from creating unnecessary drag forces as the submarine moves. However, if the primary propulsor unit should fail, it becomes necessary to deploy such secondary propulsor units from the storage chamber and through the opening in the hull to a position outside of the hull where their electric motors may be actuated in order to drive the submarine into a port for repairs.

The prior art systems used to deploy such propulsor units have generally comprised an extendible mast which connects the propulsor unit to the ceiling of the storage chamber, and one or more lead screw assemblies for extending and retracting the propulsor unit from the storage chamber to a position outside the hull of the submarine.

While such prior art deployment systems are capable of performing their assigned task, the applicants have noted a number of areas where the design of such systems which could stand improvement. For example, the extendible masts used in such systems are quite heavy, weighing in the neighborhood of several thousand pounds. This weight, in combination with the space requirements for such a mast (which are still considerable even when the mast is collapsed to its most compact condition) disadvantageously reduces the cargo capacity of the submarine that might be better used for carrying food and water supplies, or additional weapons. The same weight and space requirements further necessitates the placement of such prior art deployment systems near the rear of the main drive shaft exit in the aft pressure bulkhead, which is well behind the center of gravity of the sub. Such placement tends to pull the center of gravity of the submarine backwards, thereby necessitating the placement of additional weight in the front of the submarine, which again has the effect of reducing the cargo capacity of the vehicle. Finally, whenever the propulsor unit is deployed by such prior art systems, its storage cavity in the submarine hull is left open, creating fluid drag which not only slows the submarine down, but which also creates unwanted noise that makes it easier for hostile nations to detect the location of the submarine. Additional unwanted drag and noise is created by the hole cover plate (which is mounted on the bottom of the propulsion unit) when the secondary propulsor is deployed into the ambient water and operated.

Clearly, what is needed is a deployment system for such a secondary propulsor unit that is lighter in weight, and smaller in volume than prior art deployment systems which would not only have the effect of increasing the effective cargo capacity of the submarine, but which would also allow the secondary propulsor unit to be mounted closer to the center of gravity of the submarine, thereby increasing its efficiency. Ideally, such an improved deployment system would be simpler in design, but more reliable than existing deployment systems that utilize the combination of a telescoping mast and a plurality of motorized, coordinated lead screws to extend and retract the propulsor unit from the hull of the submarine. Finally, there should be no fluid drag associated with the opening in the hull that leads to the propulsor unit storage chamber when the unit is deployed and operated.

SUMMARY OF THE INVENTION

Generally speaking, the invention is a system for deploying a mechanism such as a propulsor unit from a submersed portion of the hull of a water vehicle that comprises an opening in the submersed hull portion that leads to a chamber for storing the propulsor unit, a cover means for covering the hull opening to render the surface of the hull substantially continuous and fluid-dynamic after the unit is deployed, and a means for pivotally mounting both the cover means and the propulsor unit with respect to the hull for allowing the propulsor unit to move from a stored position within the storage chamber to a deployed position in the ambient water.

The cover means preferably includes first and second sides, each of which conforms to the surface of the hull when the cover means is positioned over the opening that leads to the storage chamber. The propulsor unit may be mounted on the second side of the cover means, and the cover means may in turn be pivotally mounted across the hull opening. In the alternative, the cover means may be mechanically independent from the secondary propulsor unit, and both the propulsor unit and the cover means may be separately pivotally mounted with respect to the hull. In operation, a drive assembly pivotally moves the cover means and the propulsor unit from a first, stored position within the storage chamber to a second deployed position wherein the propulsor unit projects away from the hull and into the ambient water. In both the stored and deployed positions, the cover means assumes an orientation with respect to the surrounding hull portion that renders the surface of the hull portion both continuous and fluid-dynamic, thereby preventing both the opening and the cover means from generating unwanted drag forces and noise as the vehicle moves through surrounding water.

A locking means may be provided on the perimeter of the hull opening for securing the cover means into either the aforesaid stored or deployed position. In the preferred embodiment, the locking means includes a hydraulically-actuated, spring biased bolt which is slidably received into an edge of the cover means.

The system may further include a steering assembly for steering the propulsor unit once it is deployed to the ambient water. The steering assembly may include a rotatable mounting between the propulsor unit and the second side of the cover means, and the combination of a spur gear and a worm gear for rotatably moving the propulsor unit into a desired angular orientation with respect to the cover means.

The deployment system of the invention is lighter in weight than prior art deployment systems, and eliminates the problems of unwanted fluid drag and noise associated with such systems. It should be noted that the invention is not confined to the deployment of propulsor units per se, but is applicable to the deployment of any other type of mechanism, such as an underwater weapons system, or an instrument package.

BRIEF DESCRIPTION OF THE SEVERAL FIGURES

Figure 6:
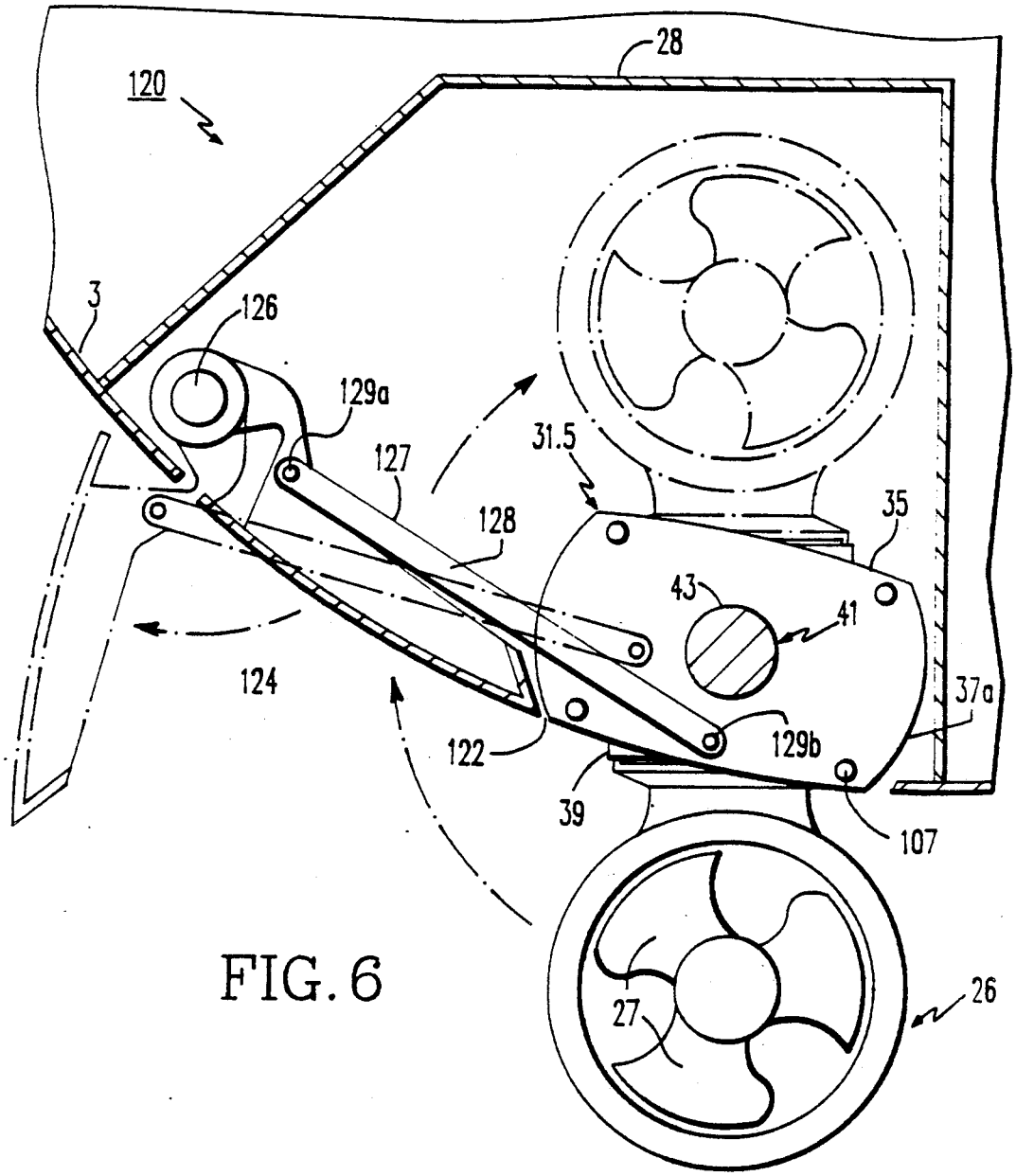
FIG. 6 is a front view of a third embodiment of the deployment system of the invention wherein the means for covering the opening in the hull that leads to the storage chamber is formed from the combination of a small pivotally mounted cover that supports the secondary propulsor unit and a pivotally mounted hatch door.
Figure 7:
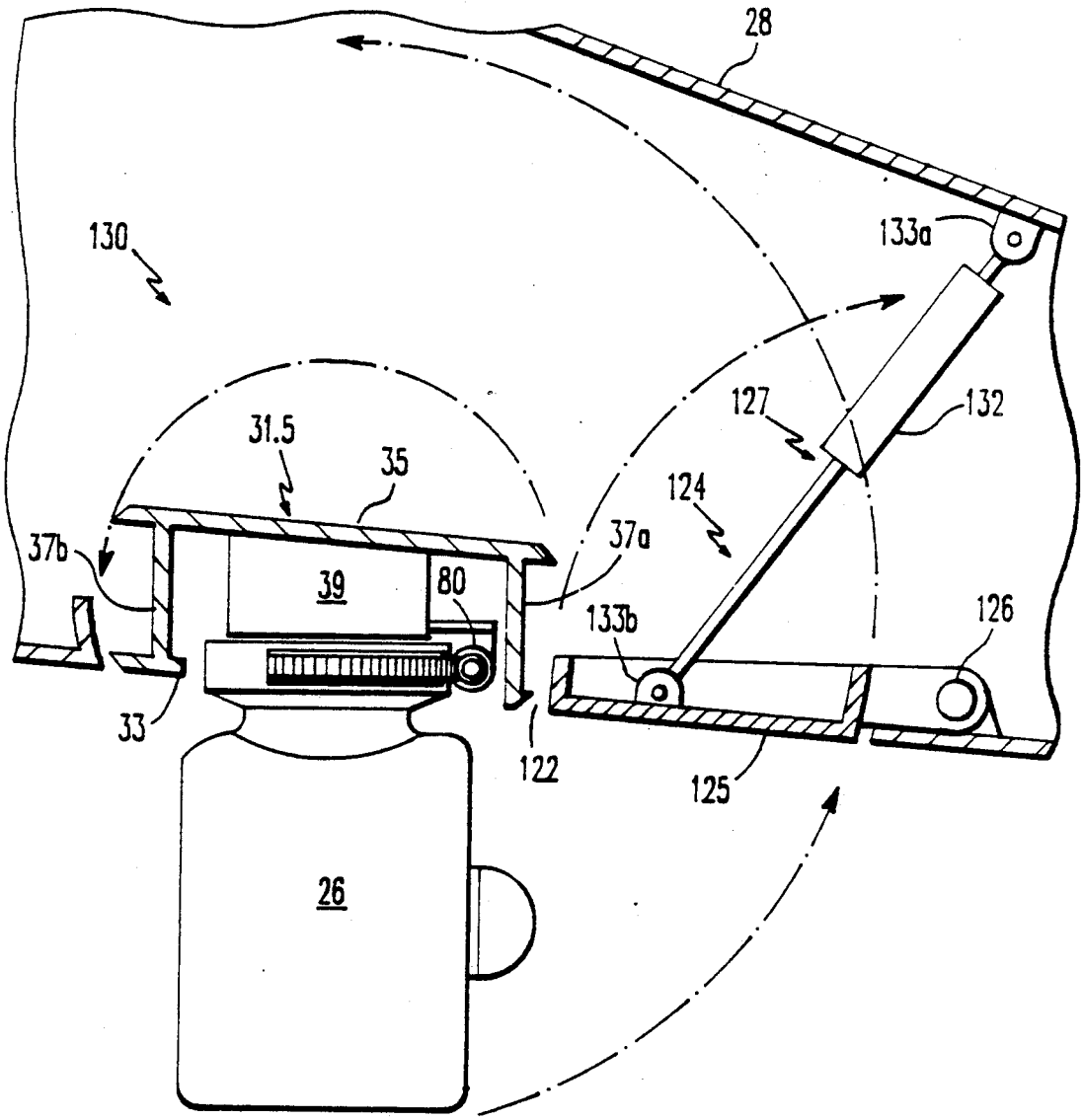
Figure 8:
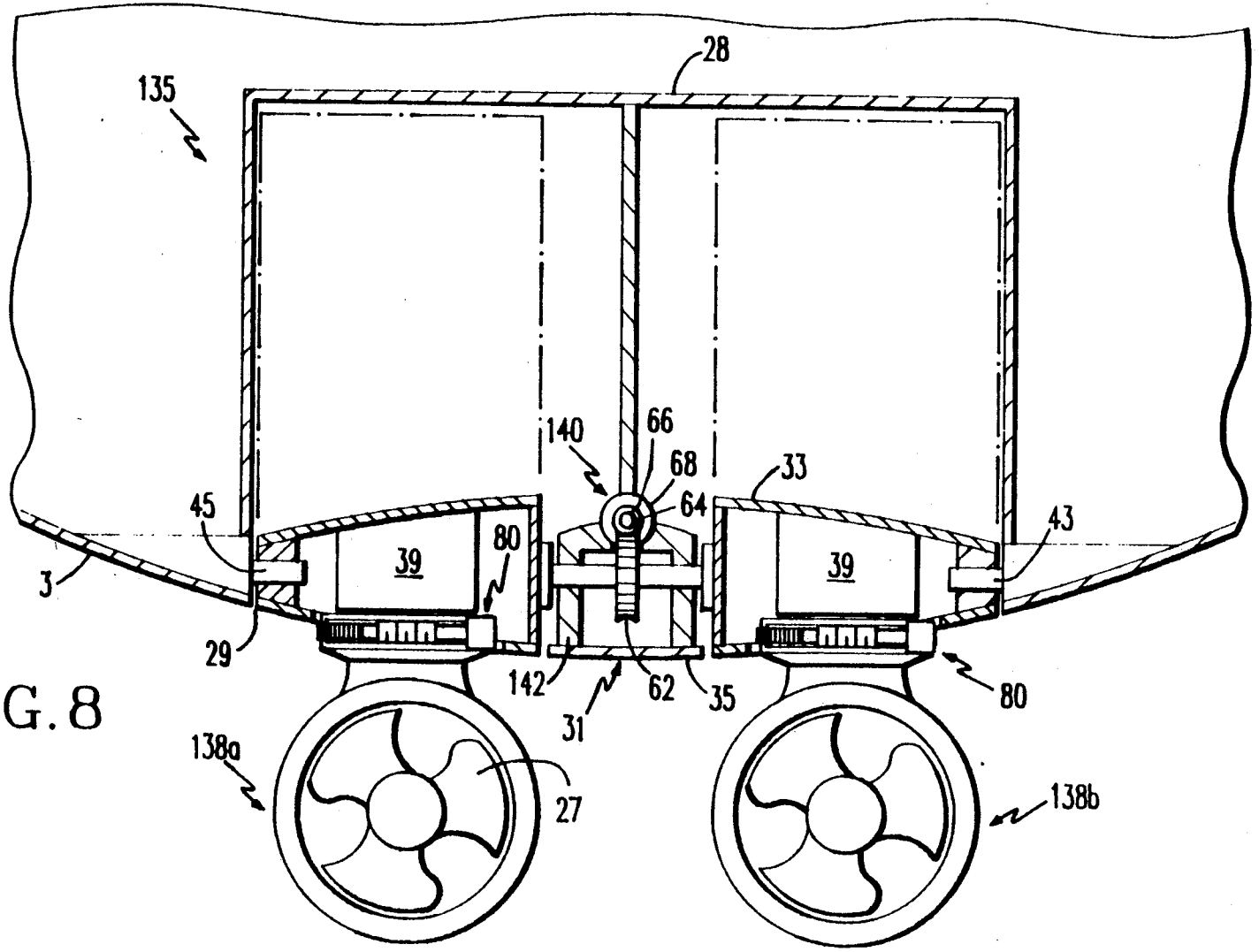

FIG. 7 is a fourth embodiment of the deployment system of the invention which is similar to the embodiment illustrated in FIG. 6 but where the cover that supports the secondary propulsor unit is pivotal along the longitudinal axis of the submarine rather than around this axis, and FIG. 8 is still another embodiment of the invention which is capable of simultaneously deploying two parallelly-mounted secondary propulsor units.

DETAILED DESCRIPTION OF THE PREFERRED EMBODIMENT

Figure 1A:
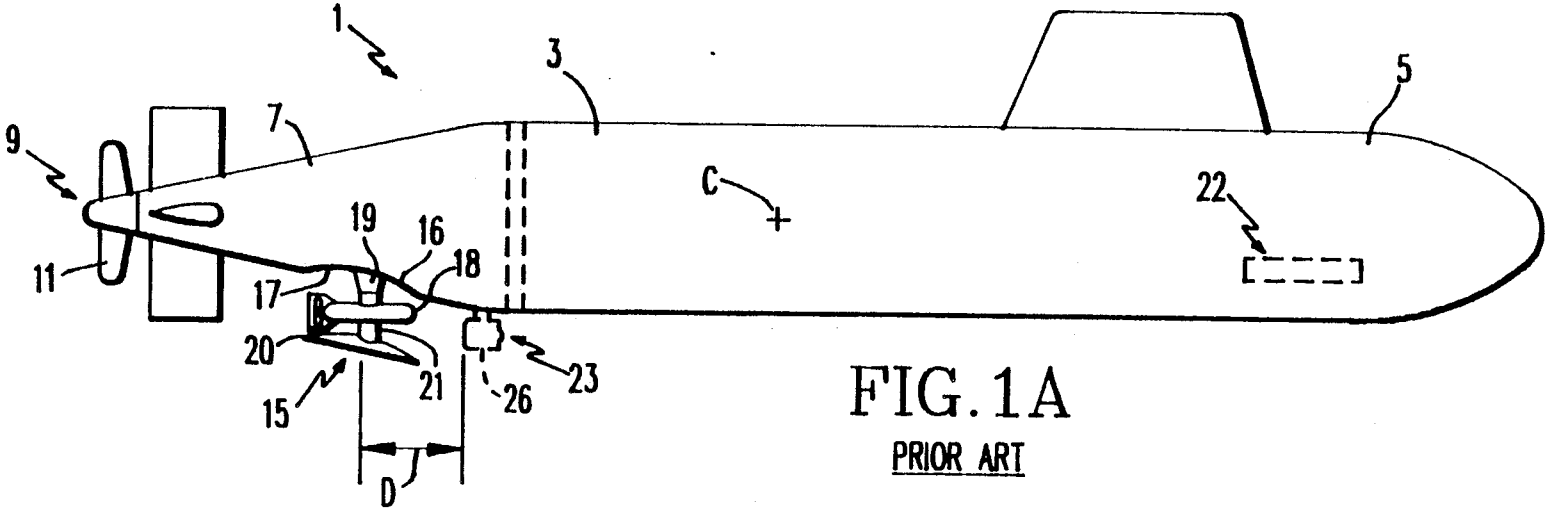
FIG. 1A PRIOR ART
FIG. 1A is a side view of a prior art deployment system for extending a secondary propulsor unit from the aft section of a submarine.
Figure 1B:
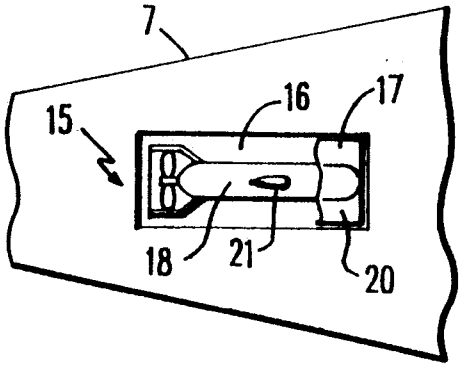
FIG. 1B PRIOR ART
FIG. 1B is a bottom view of the prior art deployment system illustrated in FIG. 1A.

With reference now to FIGS. 1A and 1B, wherein like reference numerals designate like components throughout all the several figures, the primary purpose of the invention is to provide an improved deployment system where a secondary propulsor unit is used to drive a submarine 1 under either a emergency or docking conditions. Such submarines 1 generally include a cylindrical hull 3 having a front end 5, and a back end 7 which is provided with a main propulsor unit 9 that terminates in a screw propeller 11. This propeller 11 is in turn connected to a shaft which is ultimately driven by a nuclear reactor (not shown). It is important to note that such submarines 1 must be designed so that the center of gravity C is located at very near the geographical center of the cigar-shaped, cylindrical hull 3. If the center of gravity C departs from this location, the submarine 1 will not float in a level position.

The weight and space requirements associated with prior art deployment systems 15 has generally required them to be located near the rear of the main drive shaft exit in the aft pressure bulkhead. To house this system 15, an opening 16 was provided on the bottom surface of the hull that led in turn to a storage chamber 17. The propulsor unit 18 itself was mounted on a mast 19 that was extendible by means of leadscrews from a retracted position completely within the chamber 17, to the extended position illustrated in FIG. 1A, wherein the propulsor unit 18 is spaced away from the hull 3 and is completely surrounded by ambient water. To keep the opening 16 closed when the secondary propulsor unit 18 was not in use, a cover lid 20 was provided underneath the unit 18. This cover lid 20 was attached to the prior art propulsor unit 18 by means of a connector assembly 21.

The aft location of the prior art deployment system 15, in combination with its considerable weight, has the effect of moving the center of gravity C of the submarine 1 backwards toward the propeller 11 unless counterweights 22 are provided at the front end of the submarine 1. Of course, the space and weight requirements of the prior art deployment system 15, in combination with the counterweights 22 that the prior art system necessitates, effectively reduces the cargo-carrying capacity of the submarine 1. Moreover, a significant amount of unwanted fluid drag and noise is produced both by the uncovered opening 16, and the non-fluidically shaped cover lid 21 when the prior art propulsor unit 18 is deployed and operated in the position illustrated in FIG. 1A.

With reference now to FIGS. 1A, and 2A, 2B and 2C, the deployment system 23 of the invention was developed to reduce the space and weight requirements of the deployment system used in connection with the secondary propulsor unit as well as to reduce the drag and noise that results when the unit is deployed outside its storage chamber. As is shown in phantom in FIG. 1A, the smaller size and weight requirements of the deployment system 23 of the invention allow it and its associated secondary propulsor unit 26 to be located closer to the center of gravity C of the submarine 1 by a distance D, which in turn reduces the amount of counterweights 22 that must be incorporated into the front end 5 of the hull 3 to insure that the submarine 1 maintains a level orientation. As will be understood more fully hereinafter, the relatively compact size and low weight of the deployment system 23 of the invention is the result not only of the replacement of the heavy, extendible mast 19 of the prior art with a pivotally-mounted cover, but also the replacement of the relatively elongated and heavy prior art secondary propulsor units 15 with a shorter, smaller and more efficient secondary propulsor unit 26 of the type described and claimed in co-pending U.S. patent application Ser. No. 07/571,942 filed Aug. 23, 1990.

Figure 2A:
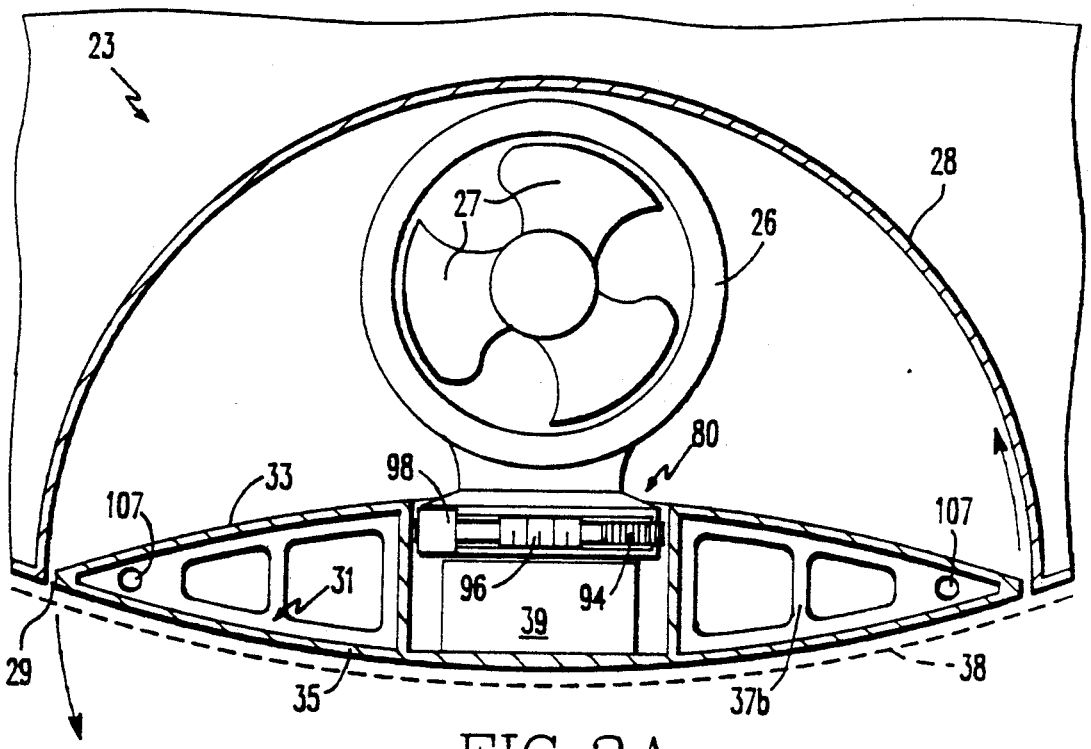
FIG. 2A is a cross-sectional front view of a preferred embodiment of the deployment system of the invention as it would appear in an un-deployed state in the storage chamber in the hull of a submarine.
Figure 2B:
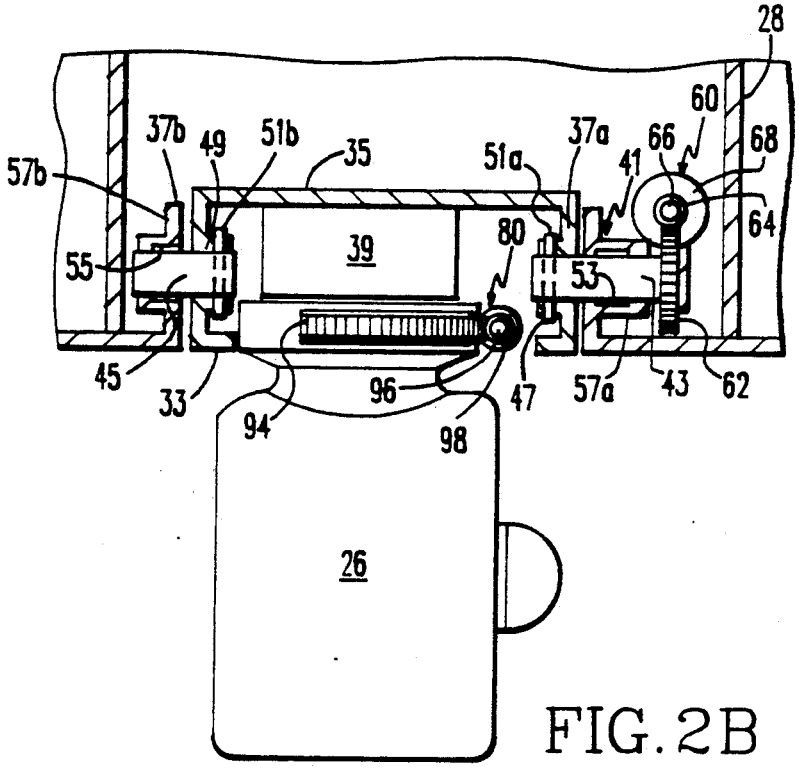
FIG. 2B is a partial cross-sectional side view of the deployment system illustrated in FIG. 2A in a deployed state.

With specific reference now to FIGS. 2A and 2B, the system 23 of the invention generally comprises a secondary propulsor unit 26 as previously described that has a centrally mounted propeller 27 driven by a rotor (not shown) mounted around the outer edges of the blades of the propeller 27, and a stator (also not shown) that is incorporated within the cylindrical housing of the unit 26. When not in use, the secondary propulsor unit 26 of the system 23 of the invention is stored within a chamber 28 defined by a cavity in the cylindrical hull 3 of the submarine 1. A generally rectangular opening 29 affords access into and out of the storage chamber 28. A cover 31 is provided over the opening 29. As will be described in more detail hereinafter, this cover 31 is advantageously pivotally mounted with respect to the opening 29 so that it completely covers the opening 29 both when the propulsor unit 26 is either a deployed or un-deployed position. The cover 31 is formed from inner and outer side panels 33,35 which are interconnected at their sides by means of support ribs 37*a,b*. Both of the side panels 33,35 are curved to match the contour 38 (represented by a dotted line) of the cylindrical hull 3 of the submarine 1. Such shaping of the inner and outer side panels 33,35 gives the submarine hull 3 a continuous and fluidic shape in the vicinity of the opening 29 when the propulsor unit 26 is in either a deployed position or a stored position within the chamber 17.

Figure 2C:
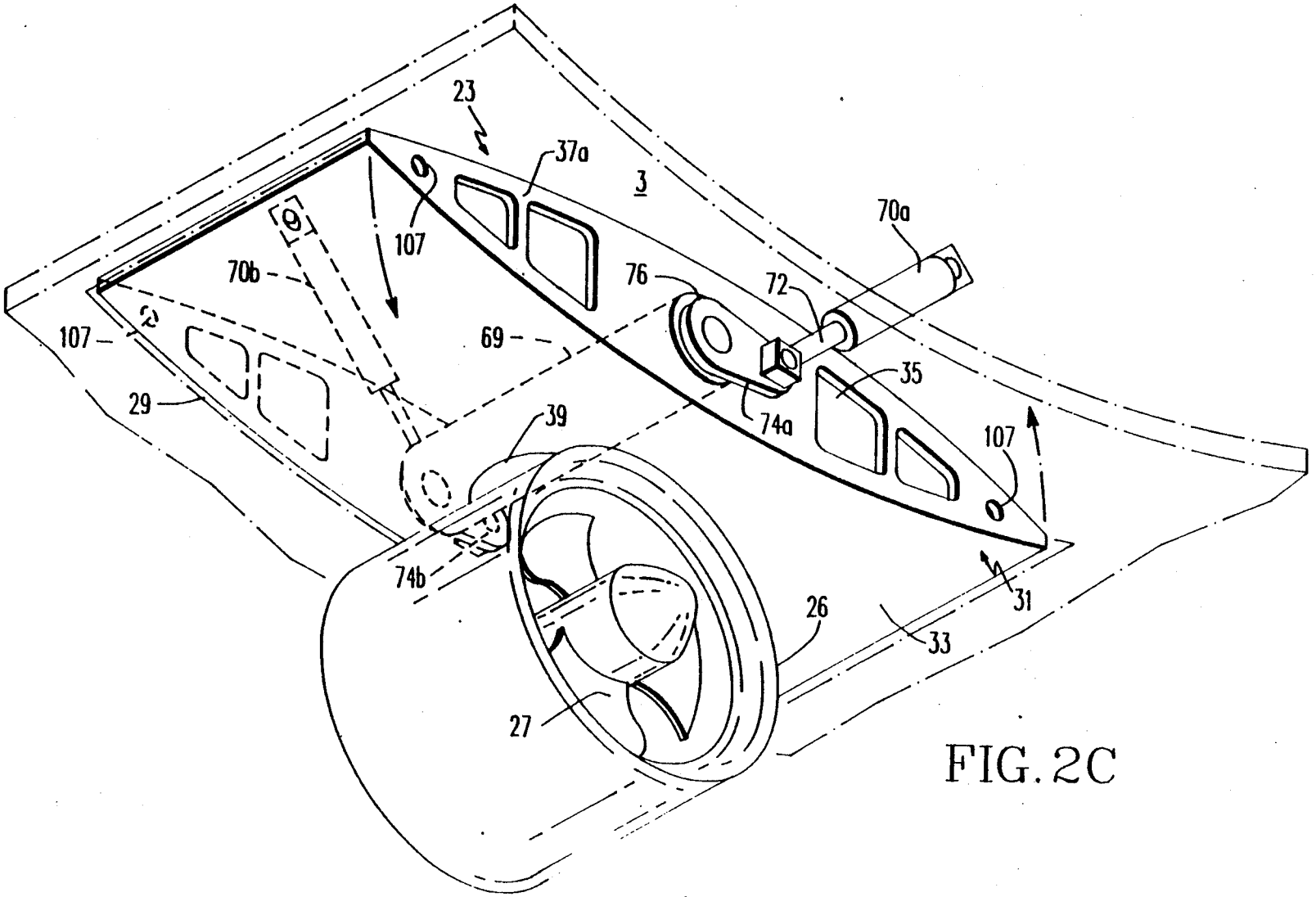
FIG. 2C is a modified version of the deployment system illustrated in FIGS. 2A and 2B in which the drive assembly that moves the propulsor unit from a stored to a deployed state utilizes a pair hydraulic cylinders in combination with a crank mechanism, instead of the combination of a spur gear and worm gear.
Figure 3:
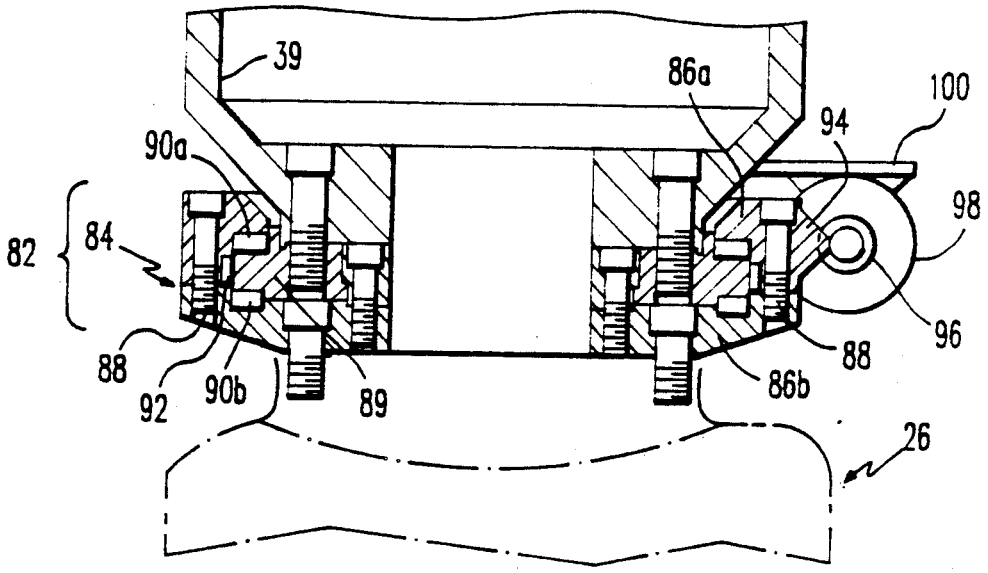
FIG. 3 is a cross-sectional side view of the steering assembly used to turn the secondary propulsor unit to a desired angle with respect to the longitudinal axis of the submarine.

In the embodiment of the system 23 of the invention illustrated in FIGS. 2A through 2C, the base of the secondary propulsor unit 26 is connected to the inside surface of the inner side panel 33 by means of a tubular coupling 39. Additionally, a pivotal mounting assembly 41 rotatably mounts the cover 31, and the propulsor unit 26 attached thereto to the fore and aft edges of the rectangular opening 29 as shown, allowing both the cover 31 and the propulsor unit 26 to rotate around the longitudinal axis of the hull 3 of the submarine 1. The pivotal mounting assembly 41 comprises a front stub shaft 43, and a back stub shaft 45. The distal ends of these shafts 43,45 are secured within annular flanges 47,49 present in the support ribs 37*a,b* by means of pins 51*a,b*. The proximal ends of the front and back stub shafts 43,45, are journalled within front and rear shaft bearings 53,55. These shaft bearings 53,55 are in turn supported on the edges of the hull 3 which define the opening 29 by means of bearing supports 57*a,b* which are preferably integrally formed with the hull 3.

The deployment system 23 of the embodiment of the invention illustrated in FIGS. 2A, 2B and 2C further includes a drive assembly 60 for selectively pivoting the cover 31 and the propulsor unit 26 attached thereto from the stored position illustrated in FIG. 2A to the deployed position illustrated in FIG. 2B. This drive assembly 60 is formed from a spur gear 62 which is secured around the proximal end of the front stub shaft 43, and a worm gear 64 supported on a shaft 66 of an electric motor 68. In operation, the electric motor 68 is actuated whenever the system operator desires to move the propulsor unit 26 from a deployed to an undeployed position or vice versa. As will be described in more detail hereinafter, a locking mechanism is provided to positively lock the cover 31 with respect to the hull 3 in either of the positions illustrated in FIGS. 2A and 2B.

FIG. 2C illustrates a modification of the deployment system 23 illustrated in FIGS. 2A and 2B. In this modified embodiment, the drive assembly 60 is formed from a pair of double action hydraulic cylinders 70*a,b* instead of the previously described spur gear and worm gear arrangement. Each of these hydraulic cylinders 70*a,b* includes a piston rod 72 whose distal end is rotatably connected to one of an opposing pair of crank members 74*a,b*. Each of these crank members is in turn connected at the end of a rotatable shaft 76 that extends completely through the cover 31 and which is rigidly affixed through the center line of the two opposing support ribs 37*a,b*. The front and rear shaft bearings 53,55 and bearing supports 57*a,b* which rotatably support the opposing ends of the rotatable shaft 76 are not shown in FIG. 2C in order to simplify the illustration. The propulsor unit 26 in this modified embodiment is mounted on the outer surface of the inner side panel 33, as opposed to the inner surface of the outer side panel 35 due to the presence of the rotatable shaft 76 disposed within the interior of the cover 31. While the drive assembly 60 associated with the deployment system illustrated in FIGS. 2A and 2B has the advantage of being able to precisely move the propulsor unit 26 to a desired angular position with respect to the axis of rotation of the stub shafts 43,45, the hydraulically operated drive assembly 69 associated with the modified embodiment of the invention illustrated in FIG. 2C has the advantage of improved shock resistance to the drive assembly 60 illustrated in FIGS. 2A and 2B.

The deployment system 23 of the invention advantageously further includes a steering assembly 80 for rotating the propulsor unit 26 to a desired angular orientation around the tubular coupling 39. This feature gives the deployment system 23 the ability to turn the submarine 1 without changing the orientation of the steering fins located at the back end 7 of the cylindrical hull 3 of the submarine 1. To this end, the steering assembly 80 includes a rotatable mounting 82 having a bearing ring 84 that is formed from a pair of ring halves 86*a,b* secured together by bolts 88. This ring halves 86 rollingly engage an annular flange 89 that is secured onto the tubular coupling 39 by means of upper and lower, radially oriented rollers 90*a,b*. A set of peripheral rollers 92 provides rollingly engagement between the outer edge of the annular flange 89, and the inner edges of the ring halves 86*a,b*. A spur gear segment 94 circumscribes 270° of the outer edge of the bearing ring 84. The teeth of the spur gear segment 94 mesh with a worm gear 96 mounted on the shaft of an electric motor 98. The motor 98 is in turn secured onto the tubular coupling 39 by means of a bracket 100. In operation, the submarine 1 can be steered by actuating the motor 98 so that it turns the worm gear 96 to orient the secondary propulsor unit 27 to a desired orientation with respect to the longitudinal axis of the hull 3. An encoder (not shown) which generates electrical signals indicative of the degree of rotation between the cylindrical coupling 39 and the propulsor unit 27 may be incorporated within the steering assembly 80 to remotely inform the system operator of the angular orientation of the propulsor unit 27 with respect to the longitudinal axis of the submarine 1.

Figure 4:
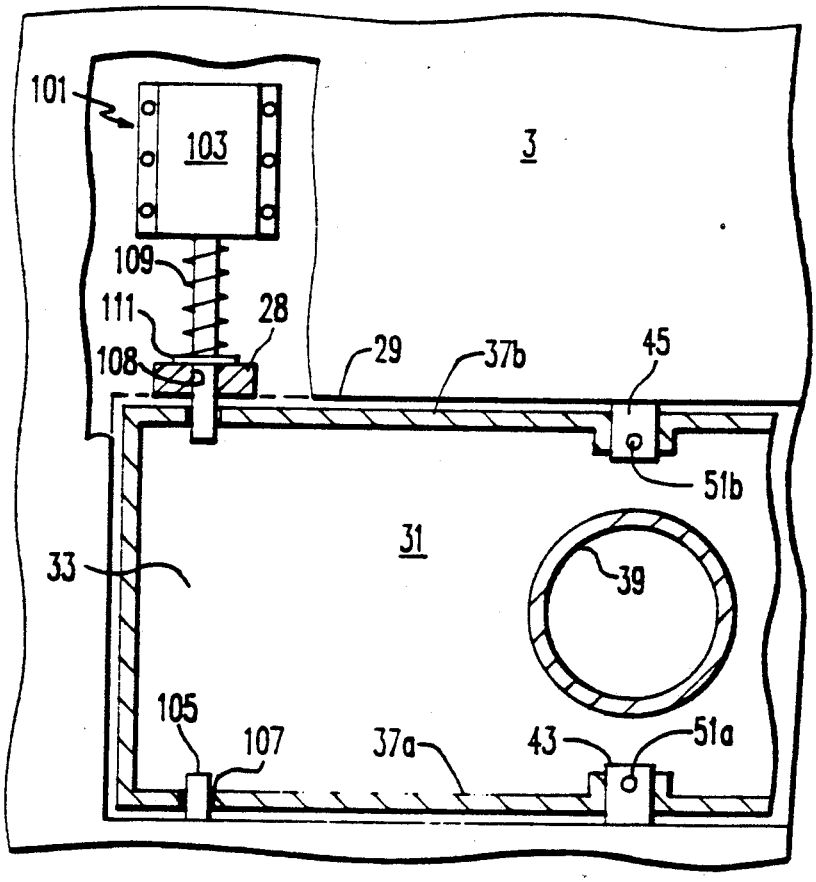
FIG. 4 is a cross-sectional plan view of the cover used in conjunction with the embodiment of the invention illustrated in FIGS. 2A, 2B and 2C, illustrating the locking mechanism which secures the cover into either an deployed or un-deployed state.

FIG. 4 illustrates the locking mechanism 101 used to secure the cover 31 into a position where the propulsor unit 27 is either stored within the chamber 28, or deployed in the position illustrated in FIGS. 2B and 2C. The locking mechanism 101 is provided with a hydraulic actuator 103 for reciprocably moving a bolt 105 that is slidably receivable within mutually registered bores 107,108 present in both the cover 31, and in the hull walls that define the storage chamber 28. Although the locking mechanism 101 includes four such hydraulic actuators 103 capable of sliding a bolt 105 into one of the four corners of the cover 31, only one such actuator 103 is illustrated in FIG. 4. The bolt 105 is circumscribed by a spring 109 that is compressed between a wall of the housing of the actuator 103, and a spring stop 111 located near the distal end of the bolt 105. The spring 109 serves to bias the bolt 105 in the locking position illustrated in FIG. 4, while the hydraulic actuator 103 functions to withdraw the bolt 105 from the bore 107 in the cover 31 whenever the system operator desires to rotate the cover 31 into a new position.

Figure 5A:
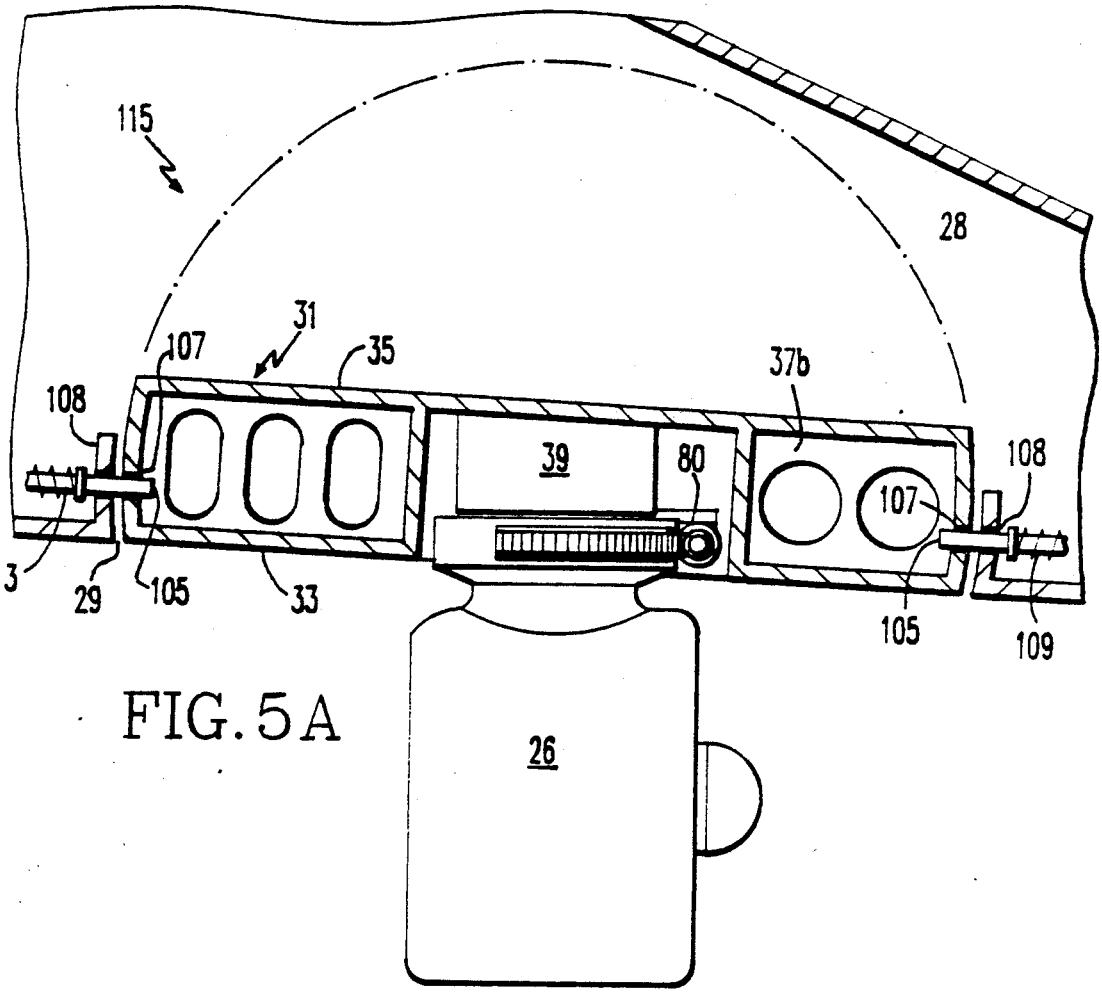
FIGS. 5A and 5B are a cross-sectional side view and a cross-sectional front view of a second embodiment of the deployment system of the invention.
Figure 5B:
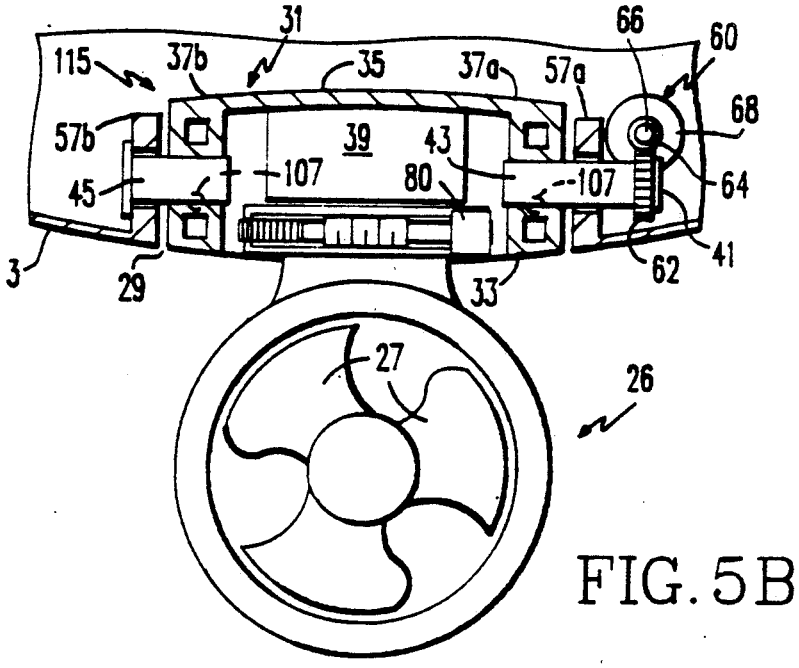

FIGS. 5A and 5B illustrate an alternate embodiment 115 of the invention. This embodiment is in many ways similar to the embodiment described with respect to FIGS. 2A and 2B, with the exception that the pivotal mounting assembly 41 allows the propulsor unit 26 to be rotatably moved along the longitudinal axis of the submarine 1, instead of around this axis. Such an orientation of the pivotal mounting assembly 41 advantageously allows the currents of water that sweep along the longitudinal axis of the hull 3 when the submarine is in motion to assist the drive assembly 60 in deploying the propulsor unit 26. While this alternate embodiment 115 has been illustrated as having a drive assembly 60 formed from the combination of a spur gear 62 and a worm gear 64, a hydraulically actuated drive assembly patterned after the drive assembly 69 illustrated in FIG. 2C could also be used.

FIG. 6 illustrates still another embodiment 120 of the deployment system of the invention wherein the means for covering the hull opening 29 is formed from the combination of a relatively small, propulsor unit carrying cover 31.5 in combination with a pivoting hatch assembly 124. By breaking up the covering means into two coacting components, this alternate embodiment 120 of the deployment system advantageously allows the storage chamber 28 of the system to be made smaller, thereby rendering the entire system 120 more compact. The pivoting hatch assembly 124 of this embodiment 120 includes a hatch door 125 which is hingedly mounted within the chamber 28 by means of hinge assembly 126. The support ribs 37*a,b* of the modified cover 31.5 are connected to the hinge assembly 136 by means of a linkage 127 formed from a tie-rod 128 as shown. The ends of the tie-rod 128 are rotatably mounted as selected points on the support rib 37*a* and the hinge assembly 126 by means of bearings 129*a,b*. As is evident in FIG. 6, when the propulsor unit 27 is pivoted from the position illustrated in phantom to the deployed position outside the hull 3 of the submarine 1, the tie-rod 128 of the linkage 127 opens the hatch door 125 so that it does not interfere with the movement of the propulsor unit 27 from one position to the other. It should be noted that this particular arrangement of the pivoting hatch assembly 124 and the linkage 127 allows the chamber 128 to be formed in an asymmetrical fashion. This advantageous, as the architecture of some submarines will not allow a storage chamber 128 to be built directly along the longitudinal center line of the bottom of the cylindrical hull 3, but rather only to one side or the other of the center line of the hull 3.

FIG. 7 illustrates still another embodiment 130 of the invention which is similar in structure and operation to the previously described embodiment 120 illustrated in FIG. 6. In this embodiment 130, both the small cover 31.5 and the propulsor unit 26 are pivotally mounted in the same orientation as the embodiment 115 illustrated in FIG. 5A and 5B, such that the propulsor unit 26 pivots along the longitudinal axis of the hull 3 of the submarine 1. Additionally, like the previously described embodiment in FIG. 6, this particular embodiment 130 also includes a pivoting hatch assembly 124 having a hatch door 125 hingedly connected to the hull 3 by means of a hinge assembly 26. However, instead of the previously described linkage 127, this embodiment 130 is provided with a door opening assembly 131 comprising a hydraulic cylinder 130 connected between a wall of the storage chamber 28 and the inside of the door 125 by means of rotatably connection 133*a,b*. In operation, the hydraulic cylinder 132 is actuated to swing the door out of the path of the small cover 31.5 and propulsor unit 26 whenever the system operator desires to change the position of the propulsor unit 26 from a deployed to an un-deployed state, or vice versa. Like the previously described embodiment 120, this embodiment 130 may also be used in conjunction with a storage chamber 28 of considerably smaller internal volume than the storage used in connection with the embodiment illustrated in FIGS. 2A through 2C, and 5A and 5B.

FIG. 8 illustrates an embodiment 135 of the deployment system which may be used to simultaneously deploy a pair of secondary propulsor units 138*a,b*. This particular embodiment 135 is quite similar in structure and operation as the previously described system illustrated in FIGS. 5A and 5B, the primary difference being a modified drive assembly 140 supported on a bracket 142 centrally disposed within the cover 33 and mounted on the inner surface of the outer side panel 35.

I claim:

1. A system for deploying a propulsor unit from a submersed portion of the hull of an underwater vehicle, wherein said unit includes a submersible motor having an output shaft, and a propeller connected to said shaft, comprising:

an opening in said submersed hull portion that leads to a chamber that communicates with ambient water for storing said unit;

means for pivotally mounting the motor of said unit with respect to said chamber for pivotally deploying the motor and propeller of said unit from said chamber to the water surrounding said hull portion;

a cover means pivotally mounted to said hull for covering said hull opening when said unit is in said chamber and when said unit is deployed in said surrounding water, wherein said cover means renders the surface of said hull substantially continuous both when said unit is in said chamber and when said unit is deployed in said surrounding water; and a steering assembly for steering said propulsor unit when said unit is deployed.

2. A system as defined in claim 1, further comprising a drive assembly for pivotally moving said unit to said chamber and to said surrounding water.

3. A system as defined in claim 2, wherein said cover means has first and second sides, and said first side covers said hull opening when said unit is disposed in said chamber, and said second side covers said hull opening when said unit is deployed in said surrounding unit.

4. A system as defined in claim 3, wherein both said first and second sides of said cover means are shaped to conform with the contour of said hull portion.

5. A system as defined in claim 2, wherein said unit is mounted on to said second side of said cover means, and said mounting means pivotally mounts said cover means to said hull portion.

6. A system as defined in claim 1, wherein said cover means and said unit are separately pivotally connected with respect to said hull.

7. A system as defined in claim 6, wherein said cover means includes a hatch door and a cover and further comprising a linkage between said cover and said hatch door so that said latch door opens to allow the unit to become deployed and then closes once the unit becomes deployed.

8. A system for deploying a propulsor unit from a submersed portion of the hull of an underwater vehicle, wherein said unit includes a submersible motor having an output shaft, and a propeller connected to said shaft, comprising:

an opening in said submerged hull portion that leads to a chamber that communicates with ambient water for storing said propulsor unit;

a cover means for covering said hull opening to render the surface of said hull substantially continuous, and means for separately pivotally mounting said cover means and said motor and propeller of said propulsor unit with respect to said chamber for allowing said propulsor unit to move from a stored position to a deployed position.

9. A system as defined in claim 8, wherein said cover means includes first and second covers, and said motor of said propulsor unit is mounted on one side of said first cover.

10. A system as defined in claim 9, wherein said first cover has first and second sides, and said first side covers part of said hull opening when said propulsor unit is disposed in said chamber, and said second side covers said hull opening when said propulsor unit is deployed in said surrounding water.

11. A system as defined in claim 10, wherein both said first and second sides of said cover means are shaped to conform wit the contour of said hull portion.

12. A system as defined in claim 8, further comprising a drive assembly for pivotally moving said propulsor unit from said stored to said deployed position.

13. A system as defined in claim 10, wherein said propulsor unit is mounted onto said second side of said first cover, and said mounting means includes means for pivotally mounting said first cover to said hull portion, and means for pivotally mounting said second cover with respect to said chamber.

14. A system as defined in claim 13, further comprising a steering assembly for steering said propulsor unit when said unit is deployed.

15. A system as defined in claim 14, wherein said propulsor unit is rotatably mounted onto the second side of the cover means, and said steering assembly rotates said propulsor unit a selected angle with respect to said rotatable mounting.

16. A system as defined in claim 8, further comprising locking means for locking said mechanism in a stored position and in a deployed position.

17. A system for deploying a propulsor unit from a submersed portion of the hull of an underwater vehicle, wherein said propulsor unit includes a motor having an output shaft, and a propeller connected to said shaft, comprising:

an opening in said submerged hull portion that leads to a chamber for storing said motor and propeller of said propulsor unit, said chamber communicating with the ambient water;

a cover means for covering said hull opening to render the surface o said hull substantially continuous, said cover means having first and second sides, each of which conforms to the contour of the hull, said propulsor being mounted on the second side of said cover means;

means for pivotally mounting both said cover means and said motor of said propulsor unit with respect to said hull for allowing said propulsor unit to move from a first stored position to a second deployed position;

a drive assembly for pivotally moving said cover means and said propulsor unit between said first and second positions;

locking means for securing said cover means into said first and second positions, and a steering assembly including means for rotatably mounting said propulsor unit to said second side of said cover means, and means for rotatably moving said propulsor unit relative to said cover means to a desired angle.

18. A system for deploying a propulsor unit from a submersed portion of the hull of an underwater vehicle, wherein said 17, wherein said means for rotatably moving said propulsor unit includes the combination of a worm gear and a spur gear.

19. A system as defined in claim 17, wherein said drive assembly includes at least one hydraulic jack means.

20. A system as defined in claim 17, wherein said locking means includes at least one hydraulically operated, spring-biased bolt.

21. A system for deploying a propulsor unit from a submersed portion of the hull of an underwater vehicle, wherein said unit includes a submersible motor having an output shaft, and a propeller connected to said shaft, comprising:

an opening in said submersed hull portion that leads to a chamber that communicates with ambient water for storing said propulsor unit;

means for pivotally mounting the motor of said propulsor unit with respect to said hull for pivotally deploying said motor and propeller of said unit with respect to said hull, and a cover means pivotally mounted with respect to said hull for covering said hull opening when said mechanism is in said chamber and when said mechanism is deployed in said surrounding water to render the surface of said hull substantially continuous, wherein said cover means and said motor of said propulsor unit are separately pivotally connected with respect to said hull.

* * * * *